US011364605B2

(12) United States Patent
Chen

(10) Patent No.: US 11,364,605 B2
(45) Date of Patent: Jun. 21, 2022

(54) MAGNETIC SLEEVE

(71) Applicant: Che-Hao Chen, Kaohsiung (TW)

(72) Inventor: Che-Hao Chen, Kaohsiung (TW)

( * ) Notice: Subject to any disclaimer, the term of this patent is extended or adjusted under 35 U.S.C. 154(b) by 406 days.

(21) Appl. No.: 16/739,395

(22) Filed: Jan. 10, 2020

(65) Prior Publication Data

US 2021/0213591 A1 Jul. 15, 2021

(51) Int. Cl.
*B25B 23/12* (2006.01)
*B25B 15/00* (2006.01)

(52) U.S. Cl.
CPC ..... *B25B 23/12* (2013.01); *B25B 15/001* (2013.01)

(58) Field of Classification Search
CPC ..... B25B 23/12; B25B 15/001
See application file for complete search history.

(56) References Cited

U.S. PATENT DOCUMENTS 5,752,418 A * 5/1998 Robins ..... B25B 23/0035 81/177.85
9,833,887 B1 * 12/2017 Liu ..... B25B 21/00

FOREIGN PATENT DOCUMENTS

DE 202019002289 U1 * 7/2019 ..... B25B 15/00

* cited by examiner

*Primary Examiner* — David B. Thomas
(74) *Attorney, Agent, or Firm* — Rosenberg, Klein & Lee

(57) ABSTRACT

A magnetic sleeve includes a body and a magnetic unit disposed in a second section of the body where a locking socket and a mounting hole are formed and communicating with each other. The mounting hole is enclosed by a peripheral wall while taking a reference point as center. The peripheral wall includes at least one engagement surface and at least one curved wall surface. Each engagement surface has two transition points for meeting the wall surface. The formation of one engagement surface or more engagement surfaces not only attains a firm engagement between the magnetic unit and the mounting hole but also forms a space therebetween to discharge air from the mounting hole smoothly, thereby preventing the magnetic unit from being broken during the installation. The space is also minimized to avoid undue accumulation of metal chips and allow the magnetic unit to be held in position stably.

4 Claims, 11 Drawing Sheets

MAGNETIC SLEEVE

BACKGROUND OF THE INVENTION

1. Field of the Invention

This invention relates to a sleeve and relates particularly to a magnetic sleeve.

2. Description of the Related Art

Sleeves are commonly used in the assembly and disassembly of locking units such as bolts, nuts and screws in fields of construction, automobile service or furniture assembly. However, in order to accelerate a locking operation of the locking units while preventing the locking units from unduly trembling and solving the problem that the user should place a hand on the locking units for support when the locking units are formed with longer length, a conventional magnetic sleeve 1 is developed to help position the locking units by the magnetic force of the magnetic sleeve 1.

Referring to FIGS. 1A and 1B, the magnetic sleeve 1 has a body 11 and a magnetic unit 12 disposed in the body 11. The body 11 has a first section 111, a second section 112 connected to the first section 111 and having an engagement end 1121, a locking socket 113 recessed into the engagement end 1121, and a mounting hole 114 formed inside the second section 112 and communicating with the locking socket 113. The mounting hole 114 is formed to precisely fit the magnetic unit 12. Because the magnetic unit 12 is formed by powder sintering and press molding, the magnetic unit 12 is hard and brittle. If the magnetic unit 12 is installed in the mounting hole 114 by a pressing action directly, the air cannot be discharged outward from the mounting hole 114 owing to the equal dimensions of the magnetic unit 12 and the mounting hole 114. Meanwhile, the pressing action will exert a force on the air to further cause a reaction force to push the magnetic unit 12, and that will break the magnetic unit 12. Therefore, the magnetic unit 12 is usually clad in a protection unit 13 which is made of a soft material. Further, the protection unit 13 is formed with a plurality of grooves 131 on a periphery thereof for allowing the air to be discharged outward from the mounting hole 114. Thus, during the installation of the magnetic unit 12, the air can be discharged outward from the mounting hole 114 through the grooves 131 without pressing the magnetic unit 12. However, the magnetic unit 12 should be clad with the protection unit 13 in advance before being mounted into the mounting hole 114. The installation of the protection unit 13 not only causes extra costs, but also adds additional process, and that is not cost-effective.

Thus, a magnetic sleeve 2 is developed. Referring to FIGS. 2A and 2B, the magnetic sleeve 2 has a body 21 and a magnetic unit 22 disposed in the body 21. The body 21 has a first section 211, a second section 212 connected to the first section 211 and having an engagement end 2121, a locking socket 213 recessed into the engagement end 2121, and a mounting hole 214 formed inside the second section 212 and communicating with the locking socket 213. The mounting hole 214 is enclosed by six engagement surfaces 2141. Each engagement surface 2141 meets a periphery of the magnetic unit 22 at one point and extends to connect with another abutting engagement surface 2141. Therefore, the engagement surfaces 2141 attain an engagement between the magnetic unit 22 and the mounting hole 214 and a space is formed between the magnetic unit 22 and the mounting hole 214 for allowing the air to be discharged outward from the mounting hole 214 during the installation of the magnetic unit 22.

Hence, the arrangement of the engagement surfaces 2141 of the mounting hole 214 must precisely fit the dimensions of the magnetic unit 22 in order to achieve the engagement of the mounting hole 214 and the magnetic unit 22. However, the mounting hole 214 is formed by direct punching, and that may cause the dimensional variation of the mounting hole 214. Meanwhile, the dimensions of the magnetic unit 22 is controlled within the dimensional tolerance. Thus, the dimensional variation of the mounting hole 214 and the dimensional tolerance of the magnetic unit 32 may cause the magnetic unit 22 cannot be mounted in the mounting hole 214 effectively. If the magnetic unit 22 is enlarged to be larger than the mounting hole 214 in order to fix the magnetic unit 22 by the engagement surfaces 2141, the magnetic unit 22 will be worn excessively caused by the engagement surfaces 2141 during the installation of the magnetic unit 22. Further, the space formed between the magnetic unit 22 and the mounting hole 214 are unduly large to expose the magnetic unit 22 to a large contact area with the outside air, and that accelerates the oxidation of the magnetic unit 22 after the magnetic unit 22 is mounted in the mounting hole 214. Thus, the magnetic force of the magnetic unit 22 is reduced quickly and the service life of the magnetic unit 22 is decreased. Moreover, a great quantity of metal chips may accumulate in the overly large space, and that affects the magnetic force of the magnetic unit 22 indirectly. Although the magnetic sleeve 2 solves the problem of adding the protection unit 13 mentioned in the magnetic sleeve 1, the engagement surfaces 2141 of the mounting hole 214 and the magnetic unit 22 must be precisely fit, and that causes increased processing difficulty and raised production costs. That requires to be improved.

SUMMARY OF THE INVENTION

The object of this invention is to provide a magnetic sleeve capable of preventing a magnet unit from being broken during the installation and providing a minimized space for discharging air and position the magnetic unit stably.

The magnetic sleeve comprises a body and a magnetic unit disposed in the body. The body has a first section, a second section connected to the first section and having an engagement end, a locking socket recessedly formed in the engagement end, and a mounting hole formed inside the second section and communicating with the locking socket for accommodating the magnetic unit. The mounting hole is enclosed by a peripheral wall while taking a reference point as center. The peripheral wall has at least one engagement surface having two transition points for meeting at least one wall surface. Each wall surface is a curved surface. The formation of one or more engagement surfaces not only attains a stable engagement between the magnetic unit and the mounting hole, but also minimize a space therebetween for discharging air from the mounting hole smoothly and preventing metal chips from accumulating unduly to thereby prevent the magnetic unit from being broken during the installation and fix the magnetic unit in the mounting hole stably.

DETAILED DESCRIPTION OF THE PREFERRED EMBODIMENTS

Figure 1B:
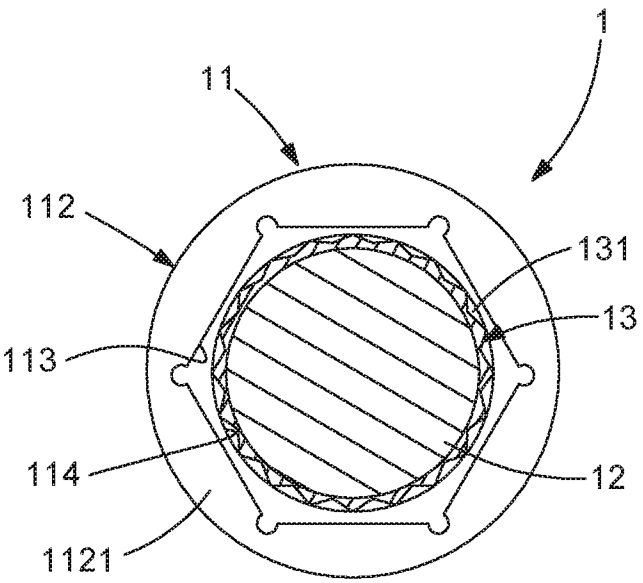
FIG. 1B (PRIOR ART)
FIG. 1B is a bottom plan view showing the installation of the magnetic unit of the conventional magnetic sleeve shown in FIG. 1A.
Figure 1A:
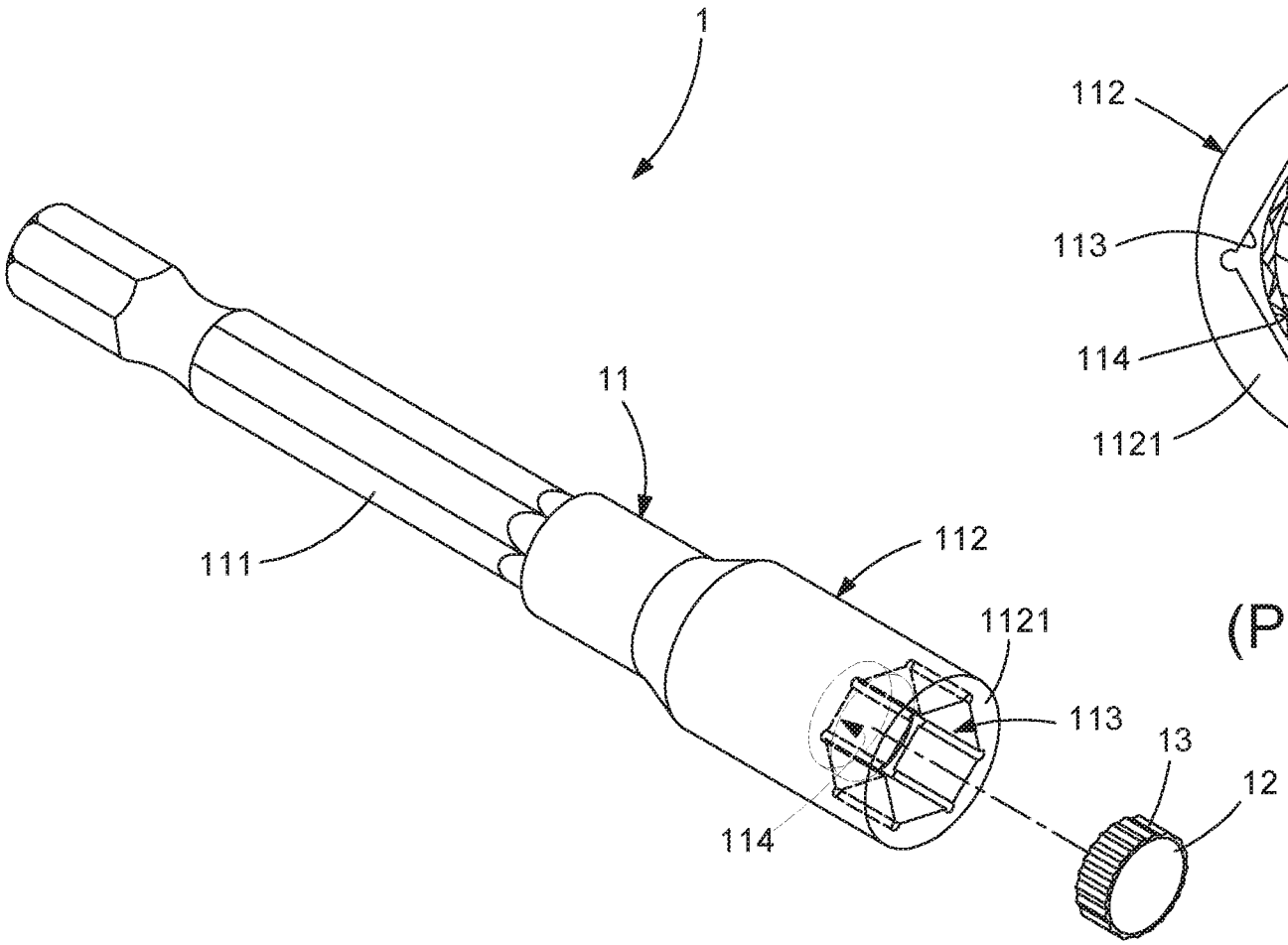
FIG. 1A (PRIOR ART)
FIG. 1A is a perspective view showing a conventional magnetic sleeve.
Figure 2B:
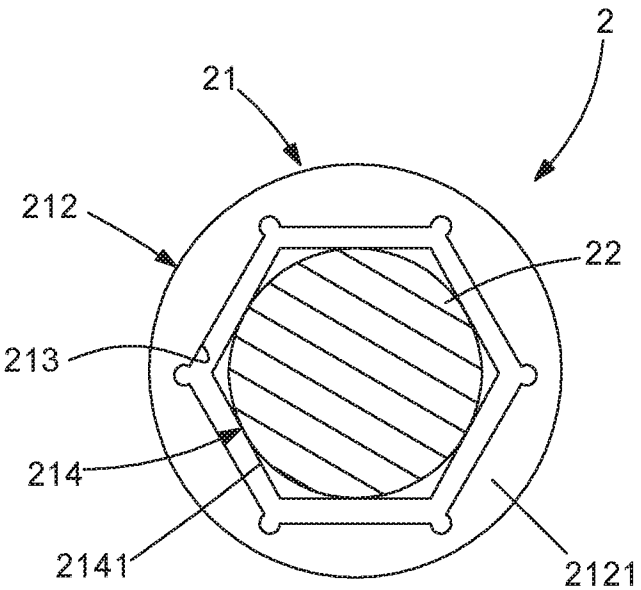
FIG. 2B (PRIOR ART)
FIG. 2B is a bottom plan view showing the installation of the magnetic unit of the conventional magnetic sleeve shown in FIG. 2A.
Figure 2A:
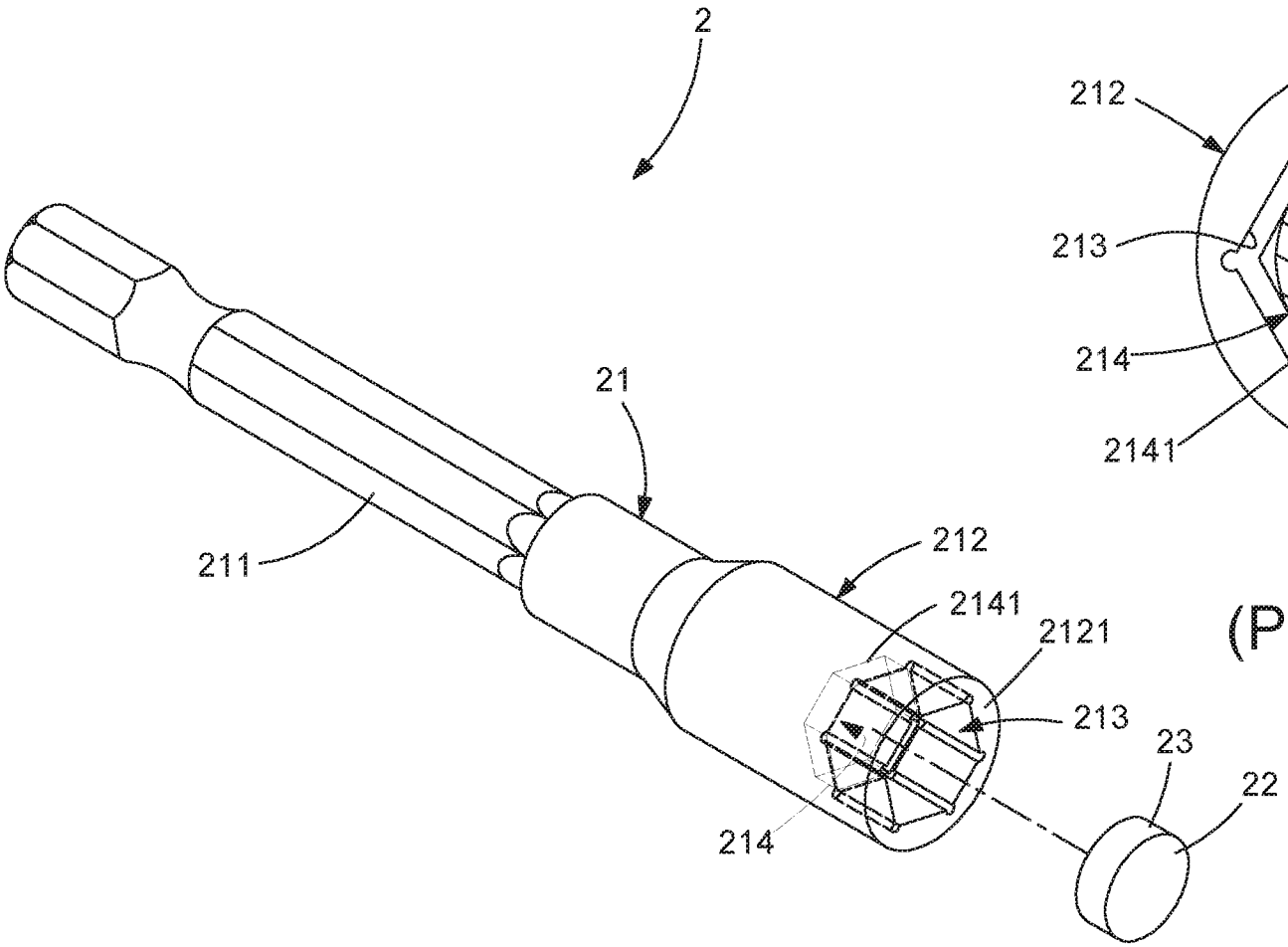
FIG. 2A (PRIOR ART)
FIG. 2A is a perspective view showing another conventional magnetic sleeve.
Figure 3:
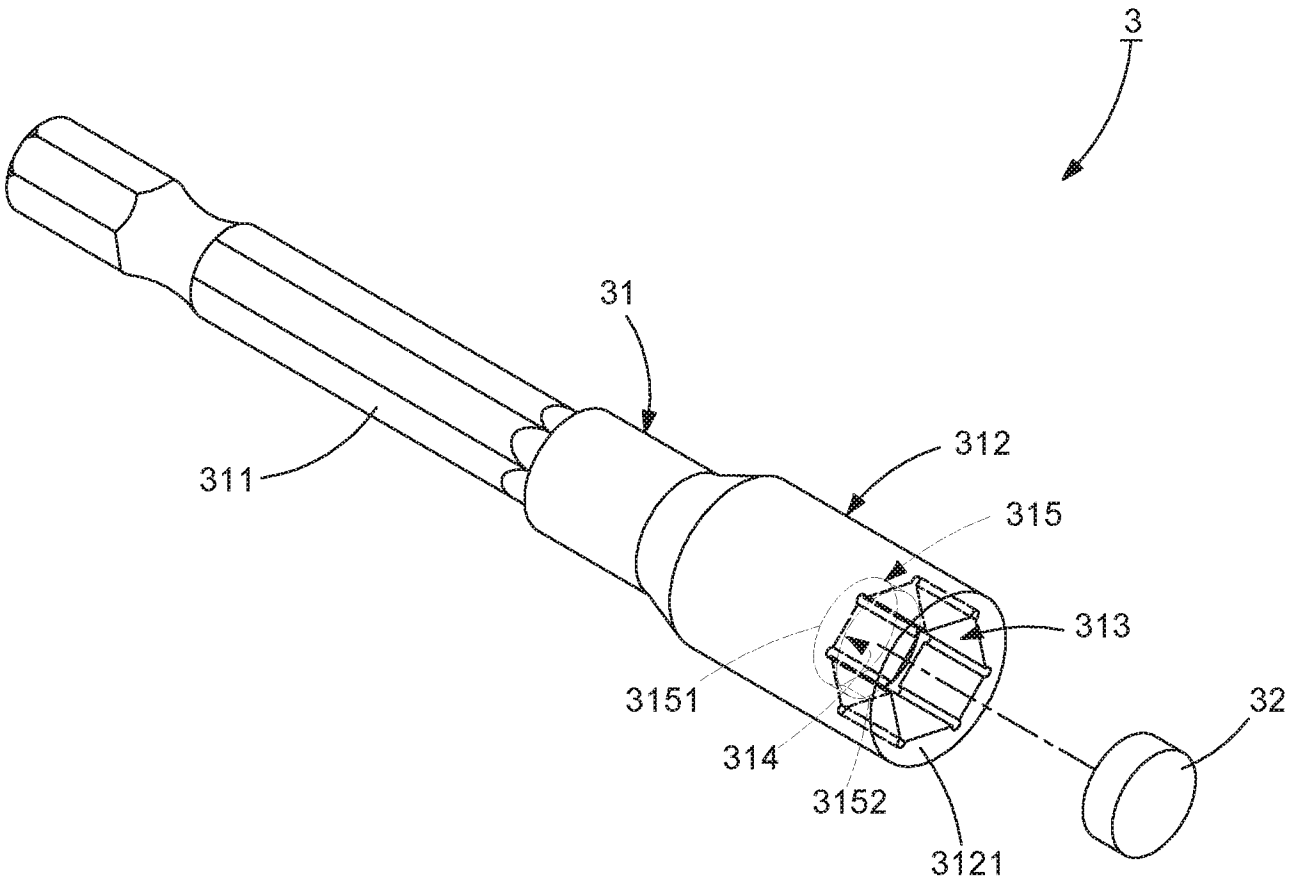
FIG. 3 is a perspective view showing a first preferred embodiment of this invention.
Figure 4:
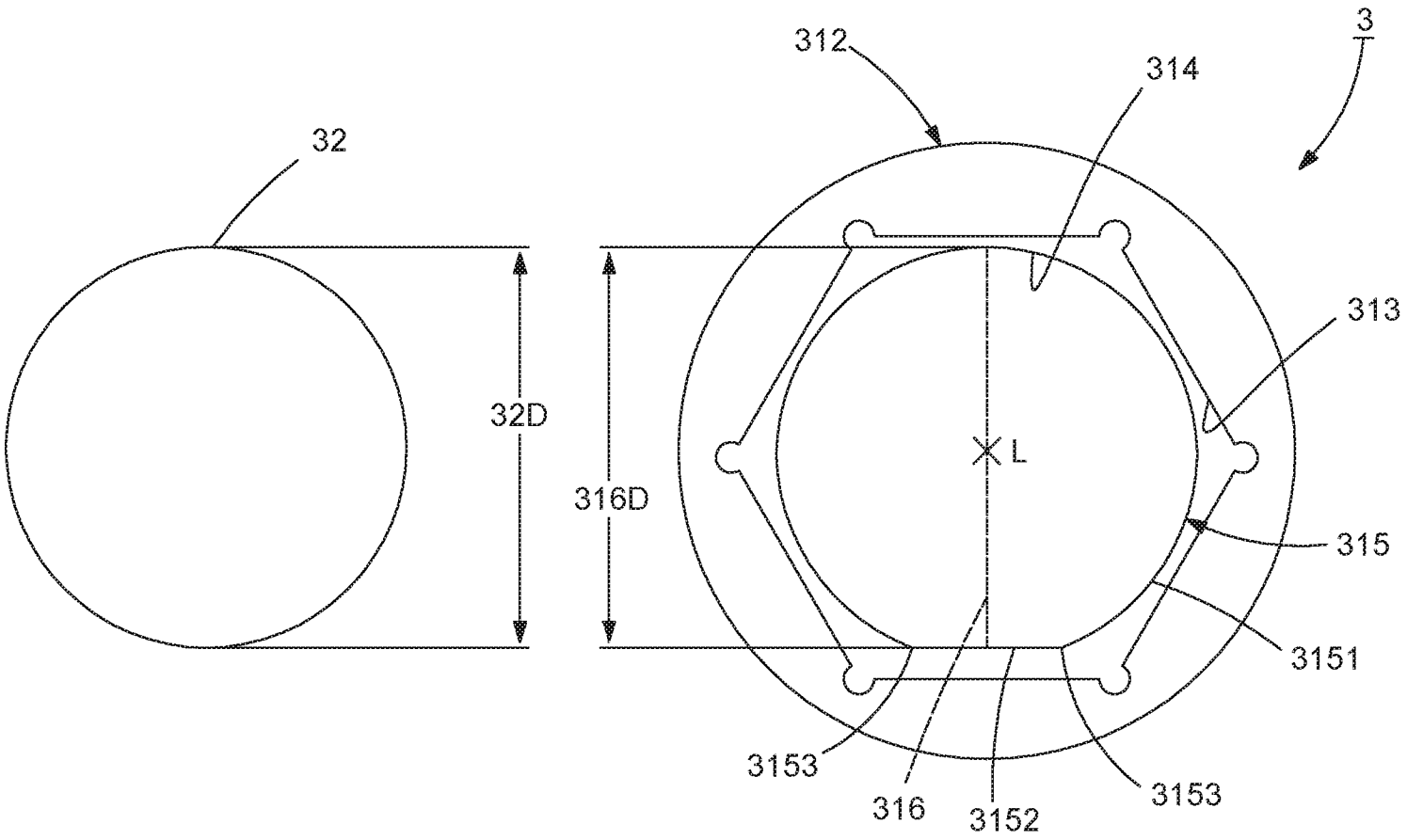
FIG. 4 is a bottom plan view showing the diameter of the magnetic unit and the length of the first reference line.

Referring to FIG. 3, a first preferred embodiment of a magnetic sleeve 3 is disclosed. The magnetic sleeve 3 in this preferred embodiment comprises a body 31 and a magnetic unit 32 mounted in the body 31. The body 31 has a first section 311, a second section 312 connected to the first section 311 and having an engagement end 3121, a locking socket 313 recessed into the engagement end 3121 of the second section 312, and a mounting hole 314 formed inside the second section 312 and communicating with the locking socket 313 for accommodating the magnetic unit 32. Referring to FIG. 4, a reference point L is defined inside the mounting hole 314. The mounting hole 314 is surrounded by a peripheral wall 315 while taking the reference point L as center. The peripheral wall 315 has a wall surface 3151 and an engagement surface 3152 different from the wall surface 3151. The engagement surface 3152 and the wall surface 3151 meet at two transition points 3153. The wall surface 3151 is formed to be curved in shape and extends between the two transition points 3153. The engagement surface 3152 is formed to be plane in shape. A diameter 32D of the magnetic unit 32 equals a length 316D of a first reference line 316 defined from the wall surface 3151 to the center of the engagement surface 3152 and passing through the reference point L to thereby restrict the magnetic unit 32 by the engagement surface 3152 tightly and form a space between the magnetic unit 32 and the mounting hole 314 when the magnetic unit 32 is mounted in the mounting hole 314 as shown in FIG. 5 and FIG. 5A.

Figure 5:
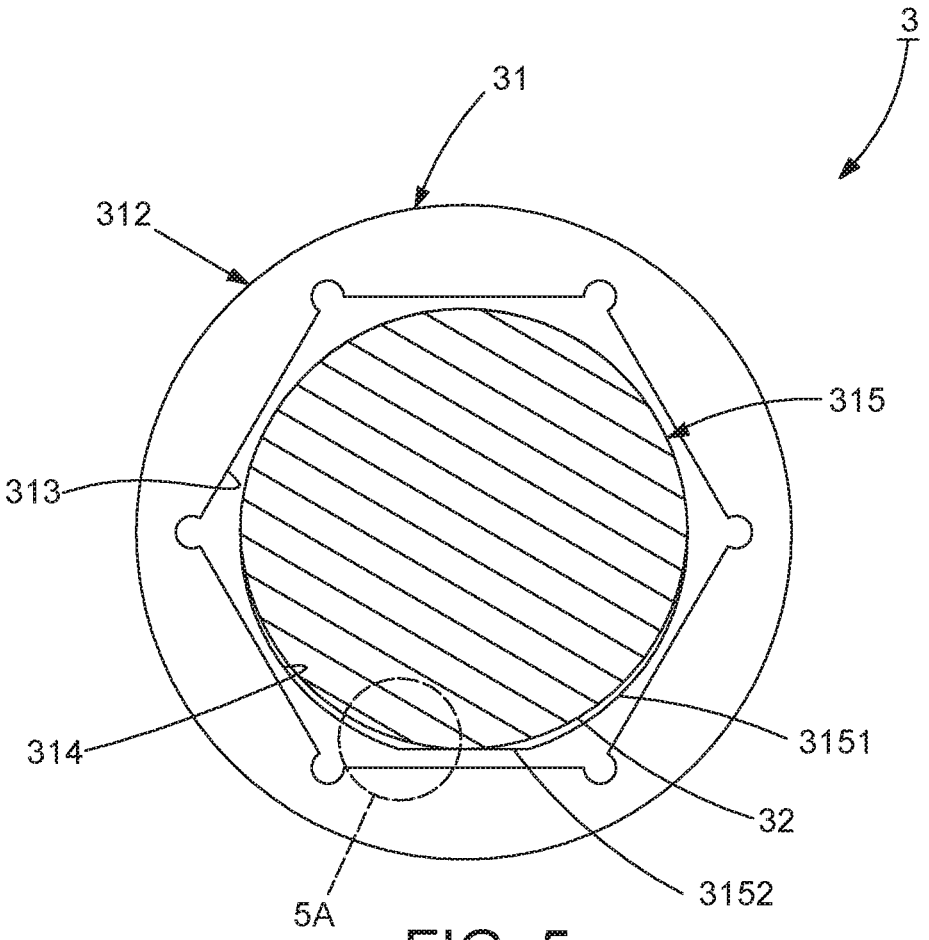
FIG. 5 is a bottom plan view showing the installation of the magnetic unit of the first preferred embodiment of this invention.
Figure 5A:
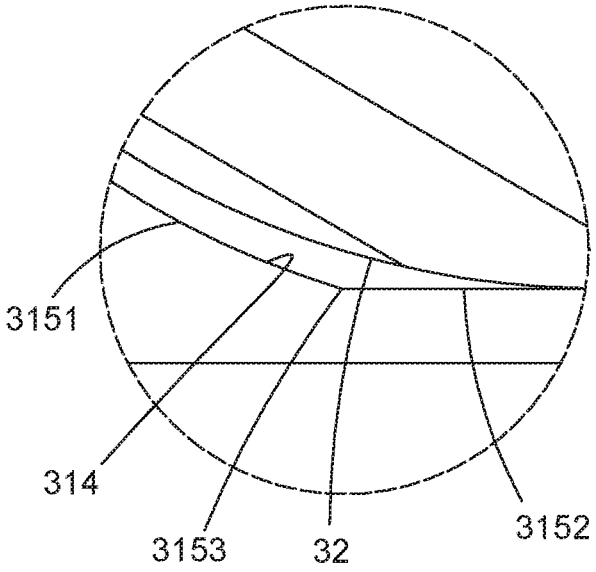
FIG. 5A is an enlarged view of the encircled portion 5A indicated in FIG. 5.

Referring to FIG. 5 and FIG. 5A, in order to proceed with the installation of the magnetic unit 32, a force is applied on the magnetic unit 32 to push the magnetic unit 32 to the mounting hole 314. The formation of the peripheral wall 315 allows the magnetic unit 32 to be slightly smaller than the mounting hole 314. Meanwhile, the slight difference between the magnetic unit 32 and the mounting hole 314 is extremely small so that the space formed between the magnetic unit 32 and the mounting hole 314 is narrowed down to the minimum. Thus, during the installation of the magnetic unit 32, air in the mounting hole 314 can be discharged outward through the space smoothly to thereby reduce a reaction force generated when pushing the air, and that prevents the magnetic unit 32 from being broken caused by the reaction force. Moreover, the minimized space can prevent metal chips from unduly accumulating and reduce an area that the magnetic unit 32 contacts the outside air to thereby slow the oxidation of the magnetic unit 32. Thus, the magnetic force of the magnetic unit 32 is greatly enhanced. Further, the plane engagement surface 3152 can effectively press and position the curved periphery of the magnetic unit 32 to thereby stably fix the magnetic unit 32.

Figure 6:
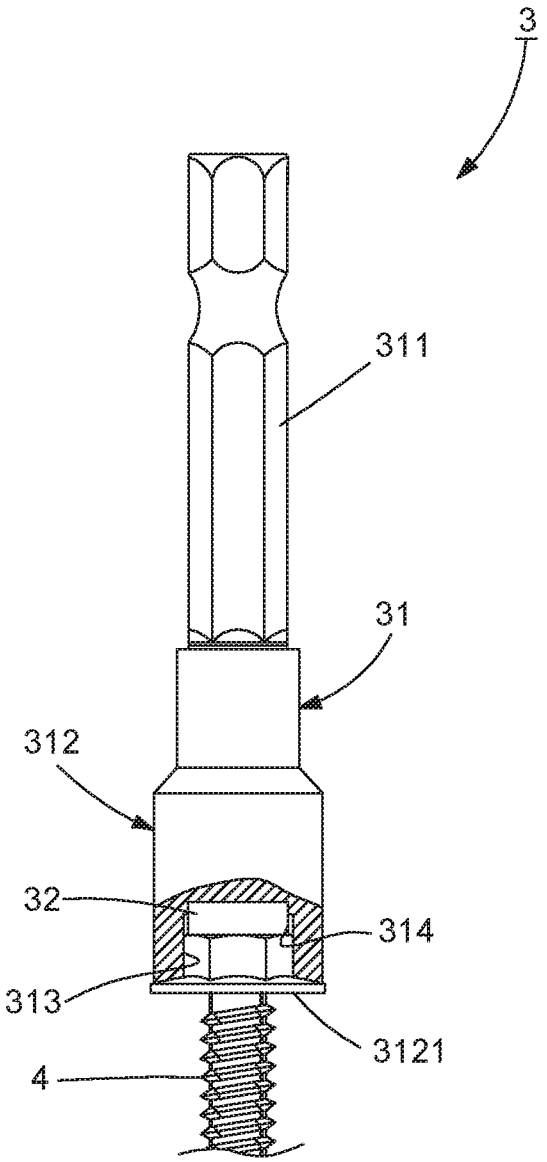
FIG. 6 is a schematic view showing the operation of the magnetic sleeve.

Referring to FIG. 6, after the magnetic unit 32 is stably mounted in the mounting hole 314, the user can sleeve a drive tool (not shown) on the first section 311 and position a locking unit 4 in the locking socket 313 to proceed the assembly and disassembly of the locking unit 4 through the magnetic sleeve 3. The magnetic force of the magnetic unit 32 allows the magnetic sleeve 3 to attract and position the locking unit 4 effectively to thereby prevent the locking unit 4 from unduly trembling during the operation and solve the problem that the user should place a hand on the locking unit 4 for support. Thus, the assembly and disassembly of the locking unit 4 can be executed quickly.

Figure 7:
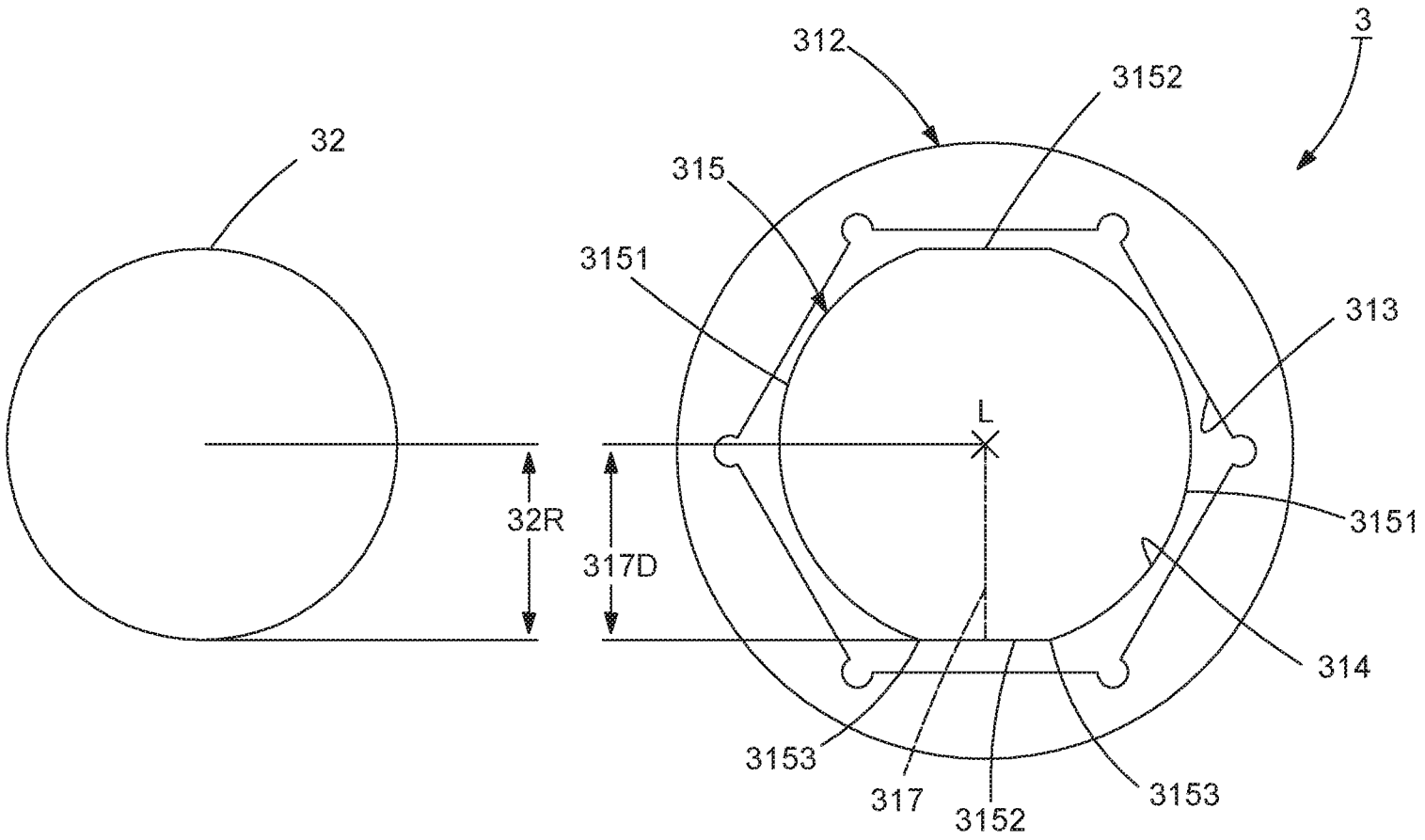
FIG. 7 is a bottom plan view showing a second preferred embodiment of this invention characterized by two engagement surfaces.
Figure 8:
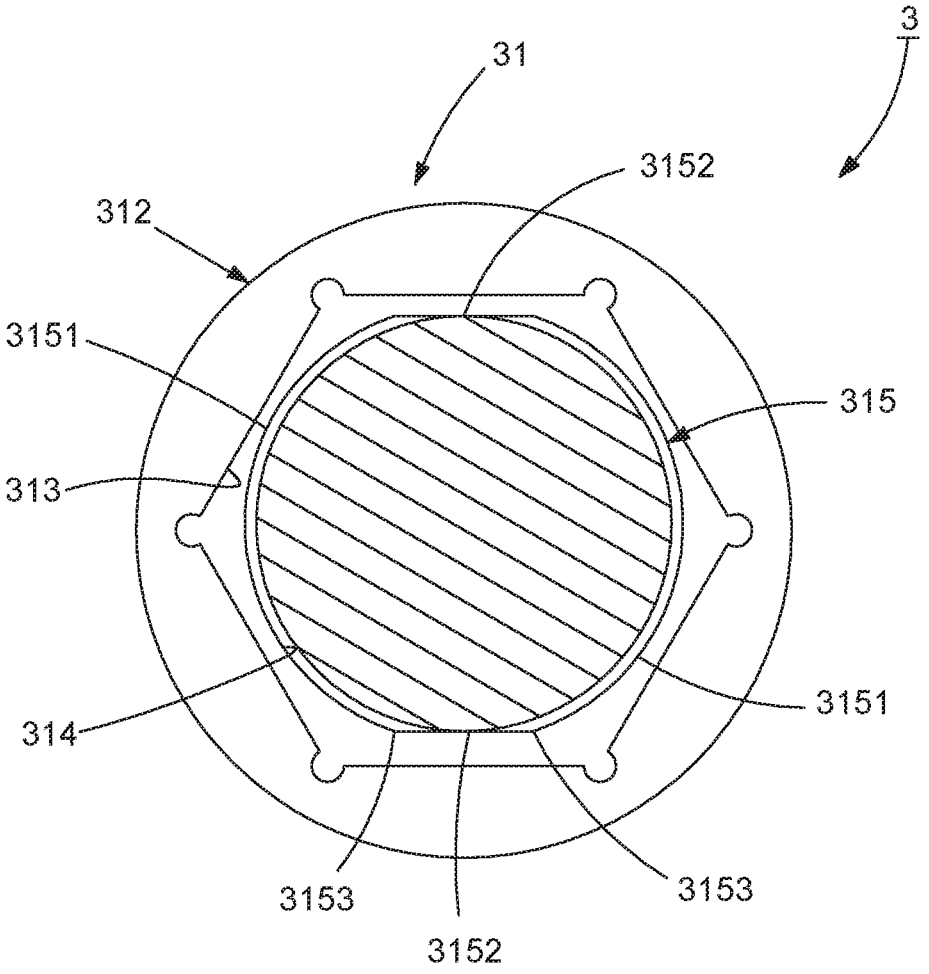
FIG. 8 is a bottom plan view showing the installation of the magnetic unit of the second preferred embodiment of this invention.
Figure 9:
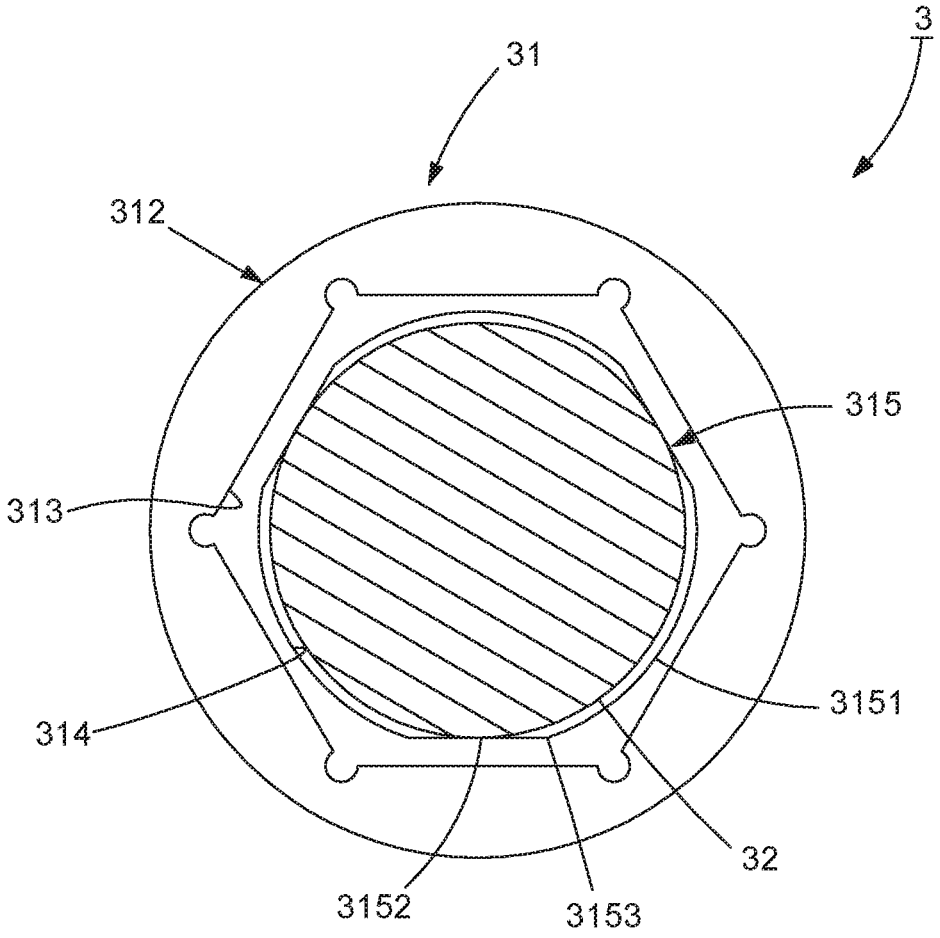
FIG. 9 is a bottom plan view showing a third preferred embodiment of this invention characterized by three engagement surfaces.
Figure 10:
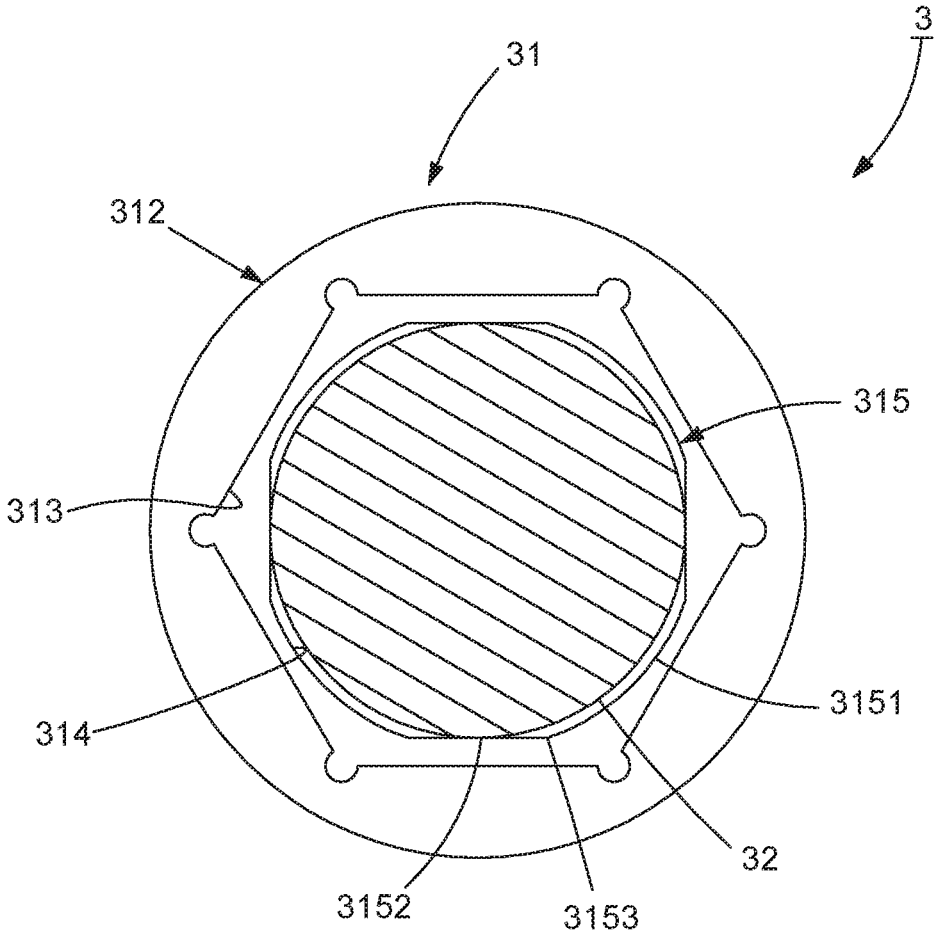
FIG. 10 is a bottom plan view showing a fourth preferred embodiment of this invention characterized by four engagement surfaces.
Figure 11:
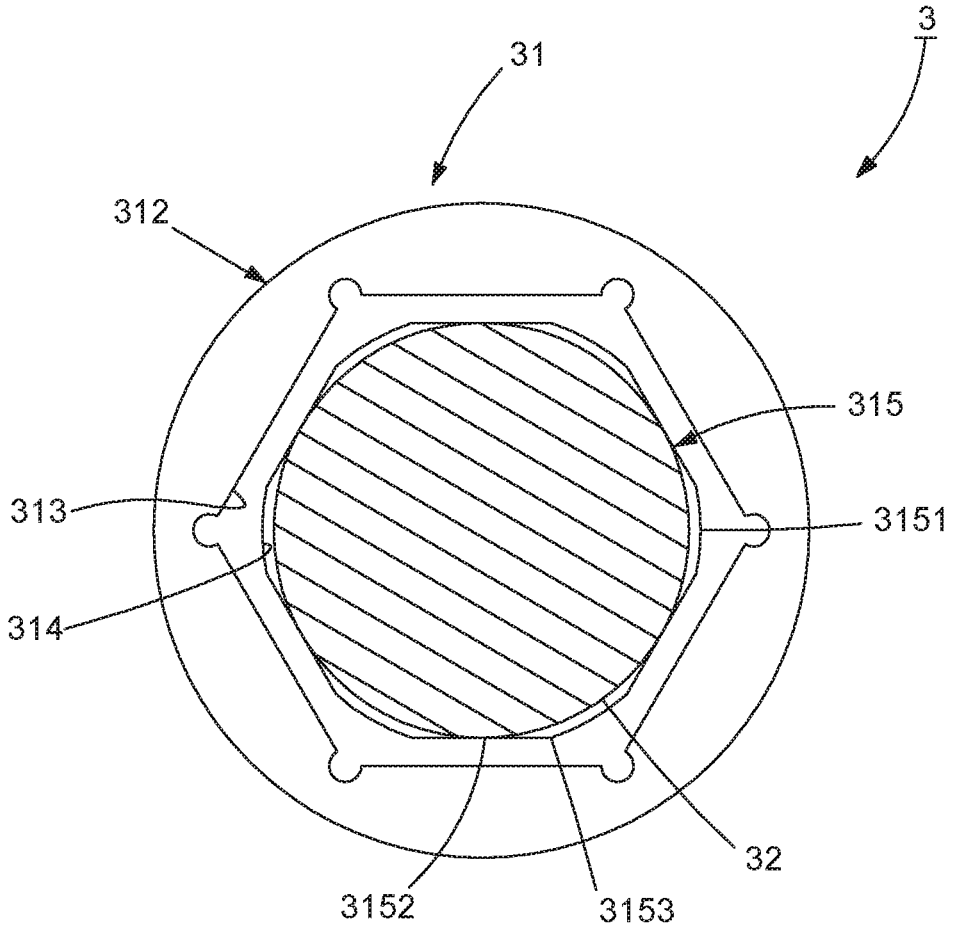
FIG. 11 is a bottom plan view showing a fifth preferred embodiment of this invention characterized by six engagement surfaces.

Referring to FIG. 7 and FIG. 8 show a second preferred embodiment of the magnetic sleeve 3 of this invention. The correlated elements and the concatenation of elements, the operation and objectives of the second preferred embodiment are the same as those of the first preferred embodiment. This embodiment is characterized in that the peripheral wall 315 has two wall surfaces 3151 and two engagement surfaces 3152. The two wall surfaces 3151 and each engagement surface 3152 meet at two transition points 3153. Each wall surface 3151 is formed to be curved in shape and each engagement surface 3152 is formed to be plane in shape. A radius 32R of the magnetic unit 32 equals a length 317D of a second reference line 317 defined from the reference point L to the center of any one of the engagement surfaces 3252. Thus, the air in the mounting hole 314 can be discharged outward through the spaces formed between the magnetic unit 32 and the mounting hole 314 to thereby avoid breaking the magnetic unit 32 during the installation of the magnetic unit 32. Meanwhile, the magnetic unit 32 and the mounting hole 314 are engaged tightly because the engagement surfaces 3152 effectively hold the magnetic unit 32 to thereby fix the magnetic unit 32 steadily. Moreover, the formation of the peripheral wall 315 can vary according to needs. For example, referring to FIG. 9 showing a third preferred embodiment of the magnetic sleeve 3 of this invention, three engagement surfaces 3152 and three wall surfaces 3151 are provided, or four engagement surfaces 3152 and four wall surface 3151 are provided as shown in FIG. 10 showing a fourth preferred embodiment of the magnetic sleeve 3 of this invention. Referring to FIG. 11 showing a fifth preferred embodiment of the magnetic sleeve 3 of this invention which is characterized in that the peripheral wall 315 has six engagement surfaces 3152 and six wall surfaces 3151.

Hence, the magnetic unit 32 can be fastened stably by increasing the number of the engagement surfaces 3152.

To sum up, the magnetic sleeve of this invention takes advantages that the peripheral wall has at least one wall surface and at least one engagement surface meeting the wall surface at two transition points to attain a stable engagement between the magnetic unit and the mounting hole and minimize the space therebetween for discharging air from the mounting hole smoothly to thereby prevent the magnetic unit from being broken during the installation. Meanwhile, the minimized space avoids undue accumulation of the metal chips and reduces the area that the magnetic unit contacts the outside air to thereby avoid affecting the magnetic force of the magnetic unit and slow the oxidation of the magnetic unit. Further, the engagement surface can tightly press the magnetic unit to thereby hold the magnetic unit in the mounting hole stably.

While the embodiments of this invention are shown and described, it is understood that further variations and modifications may be made without departing from the scope of this invention.

What is claimed is:

1. A magnetic sleeve comprising a body and a magnetic unit disposed in said body, said body including a first section, a second section connected to said first section and having an engagement end, a locking socket recessed into said engagement end of said second section, and a mounting hole formed inside said second section and communicating with said locking socket for accommodating said magnetic unit;

wherein a reference point is defined inside said mounting hole, said mounting hole being enclosed by a peripheral wall while taking said reference point as center, said peripheral wall including a wall surface and an engagement surface different from said wall surface, said engagement surface and said wall surface meeting at two transition points, said wall surface extending between said two transition points and being curved in shape, a diameter of said magnetic unit being equal to a length of a first reference line defined from said wall surface to said engagement surface, said first reference line passing through said reference point.

2. The magnetic sleeve according to claim 1, wherein said engagement surface is a plane surface.

3. A magnetic sleeve comprising a body and a magnetic unit disposed in said body, said body including a first section, a second section connected to said first section and having an engagement end, a locking socket recessed into said engagement end of said second section, and a mounting hole formed inside said second section and communicating with said locking socket for accommodating said magnetic unit;

wherein a reference point is defined inside said mounting hole, said mounting hole being enclosed by a peripheral wall while taking said reference point as center, said peripheral wall including at least two engagement surfaces spaced from each other and at least two wall surfaces alternating with said at least two engagement surfaces, said at least two wall surfaces and each of said at least two engagement surfaces meeting at two transition points, each of said at least two wall surfaces being curved in shape, a radius of said magnetic unit being equal to a length of a second reference line defined from said reference point to any one of said at least two engagement surfaces.

4. The magnetic sleeve according to claim 3, wherein each of said at least two engagement surfaces is a plane surface.

* * * * *